United States Patent [19]

Kozacka

[11] 4,322,704

[45] Mar. 30, 1982

[54] ELECTRIC FUSE, PARTICULARLY FOR USE IN CONNECTION WITH SOLID STATE DEVICES

[75] Inventor: Frederick J. Kozacka, S. Hampton, N.H.

[73] Assignee: Gould Inc., Rolling Meadows, Ill.

[21] Appl. No.: 200,687

[22] Filed: Oct. 27, 1980

[51] Int. Cl.[3] ..... H01H 85/04

[52] U.S. Cl. ..... 337/159; 337/162; 337/292

[58] Field of Search ..... 337/159, 161, 162, 290, 337/292, 296

[56] References Cited

U.S. PATENT DOCUMENTS

| | | | |
|---|---|---|---|
| 3,140,371 | 7/1964 | Johann et al. | 337/296 |
| 3,418,614 | 12/1968 | Krueger | 337/162 X |
| 3,543,209 | 11/1970 | Kozacka | 337/159 |

*Primary Examiner*—George Harris
*Attorney, Agent, or Firm*—Erwin Salzer

[57] ABSTRACT

Electric fuses according to this invention aim to increase the ratio between current-carrying capacity and $i^2 \cdot t$ values. This means, in other words, to increase the current-limiting action for any given current rating.

The fusible element of such fuses comprises an axially inner substantially planar portion of silver having at least one short-circuit neck adapted to initiate circuit interruption when said neck reaches approximately the fusing temperature of silver. The fusible element of such fuses further comprises a pair of non-planar axially outer portions of copper each having a larger width and a larger surface than said axially inner portion. The axially inner portion and the axially outer portions are conductively interconnected.

5 Claims, 3 Drawing Figures

ELECTRIC FUSE, PARTICULARLY FOR USE IN CONNECTION WITH SOLID STATE DEVICES

BACKGROUND OF THE INVENTION

For certain applications of electric fuses it is desirable to state so-called figures of merit which express certain characteristics of a particular type of fuse.

Such a figure of merit is the ratio of current-carrying capacity to $i^2 \cdot t$.

A fusible element in the form of a ribbon of copper of a given width having one short circuit neck in the center thereof has a given current-carrying capacity and the short circuit neck has a given $i^2 \cdot t$ value. By increasing the heat-dissipating area of the ends of the fusible element relative to that of its center portion the current-carrying capacity of the fusible element can be greatly increased. It has now been discovered that to achieve this the end portions of the fusible element must be made non-planar, e.g., U-shaped, while the center portion must remain substantially planar. The $i^2 \cdot t$ of the center portion can be minimized by making the center portion of silver rather than of copper.

Thus, the figure of merit which is the ratio of current-carrying capacity to $i^2 \cdot t$ can be greatly increased by increasing the numerator and descreasing the denominator of this fraction.

SUMMARY OF THE INVENTION

The common features of prior art fuses and fuses according to this invention are a tubular casing of electric insulating material, a pair of terminal elements closing said casing at the ends thereof, a granular arc-quenching filler inside said casing, a fusible element immersed in said granular arc-quenching filler and conductively interconnecting said pair of terminal elements.

The novel features which characterize fuses according to the present invention comprise a fusible element that has an axially inner substantially planar portion of silver only. That portion of the fusible element has at least one neck adapted to initiate circuit interruption when said neck reaches approximately the fusing temperature of silver. The fusible element further includes a piar of non-planar axially outer portions of copper each having a larger width and a larger surface than said axially inner portion. The axially inner portion and the axially outer portions of the fusible element are conductively interconnected so as to form a series current path.

The closest prior art I am familiar with is British Pat. No. 1,270,244 to Midland Electric Manufacturing Company Limited. The fuses shown in that patent show axially inner portions of silver and axially outer portions of copper having the same width as the axially inner portion. No consideration is given in British Pat. No. 1,270,244 to the above figure of merit which is particularly small for the fuses disclosed in that patent.

DESCRIPTION OF PREFERRED EMBODIMENT

Figure 1:
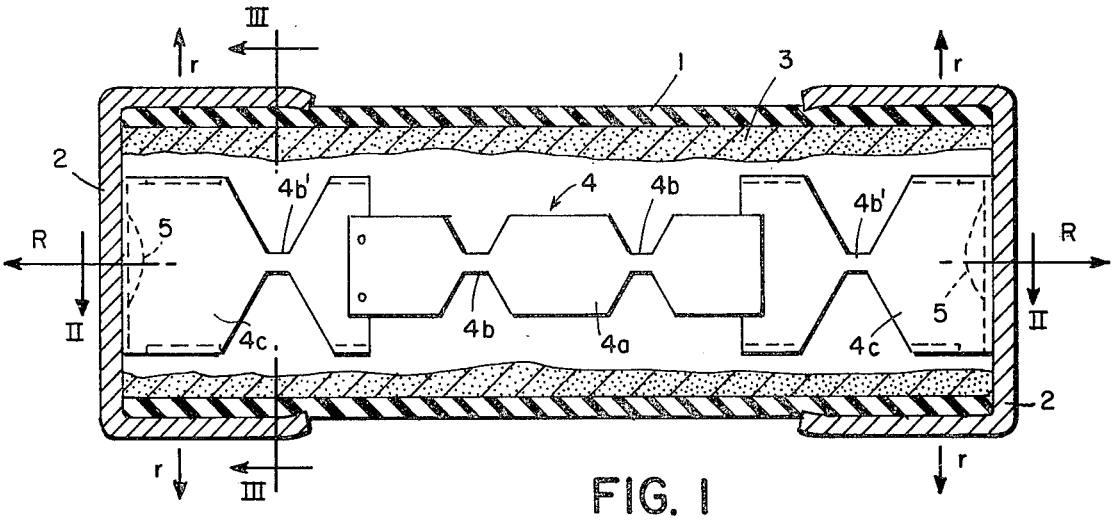
FIG. 1 shows a fuse embodying the present invention and is substantially a section taken along I—I of FIG. 2 but showing some parts in elevation rather than sectionalized.
Figure 2:
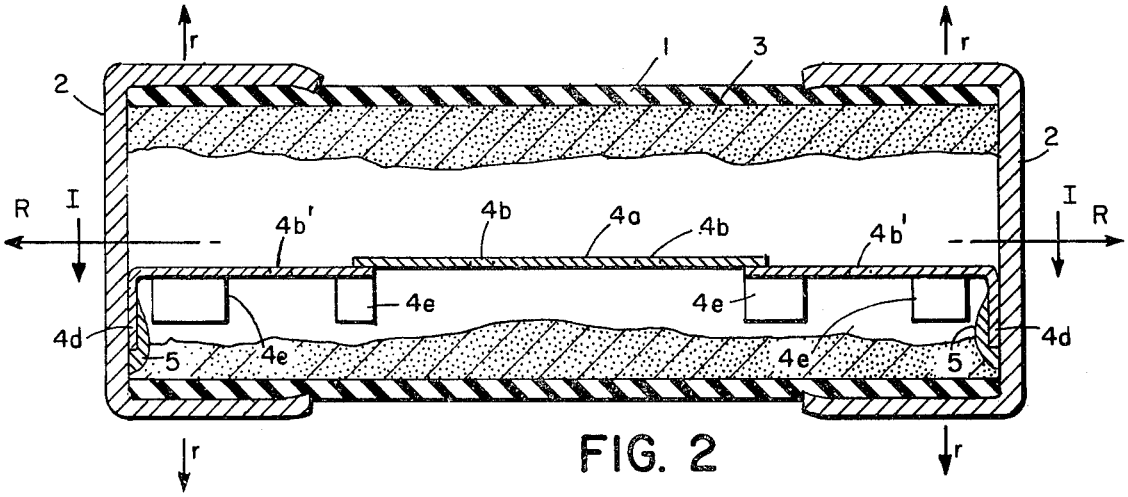
FIG. 2 is a section substantially along II—II of FIG. 1.
Figure 3:
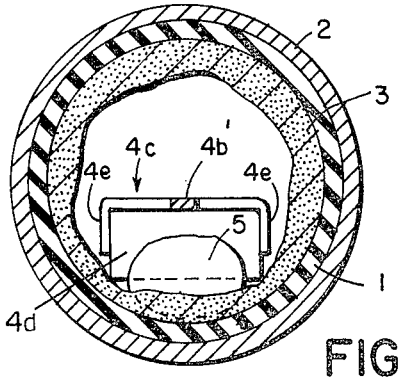
FIG. 3 is a section along III—III of FIG. 1.

Referring now to the drawings, numeral 1 has been applied to indicate a tubular casing of electric insulating material, such as, e.g., a glass-cloth-melamine laminate. Casing 1 is closed at the ends thereof by a pair of terminal elements 2 which may either be in the form of caps or ferrules, or in the form of plugs engaging the inner surface of casing 1. Casing 1 is filled with a granular arc-quenching filler 3, preferably quartz sand. Fusible element 4 comprises an axially inner substantially planar portion 4*a* of silver having at least one short-circuit neck 4*b* adapted to initiate circuit interruption when said neck reaches approximately the fusing temperature of silver, i.e., 940 deg.C. The fusible element 4 further comprises a pair of non-planar axially outer portions 4*c* of copper each having a larger width and a larger surface than the axially inner portion 4*a* of silver. The axially inner and the axially outer portions 4*a*, 4*c* are conductively interconnected as, for instance, by spot-welding, or soldering with a high melting point solder. The conductive connection of the metals silver and copper may involve some difficulties if the right methods are not applied. The patent application of R. J. Panaro et al., Ser. No. 06/168,329 filed 07/16/80 for STRESS RELIEVING WELD JOINT FOR COMPOSITE USIBLE ELEMENTS provides a simple and effective method for conductively interconnecting parts or fuse link portions 4*a* and 4*c*.

As shown in the drawings, the axially outer portions 4*c* of the fusible element 4 are wider than the axially inner portions 4*a*. Portions 4*c* are not planar to increase their heat exchange area and may, e.g., be channel-shaped as shown in the drawing. The web portions 4*d* project beyond the flange portions 4*e* in a direction longitudinal of the fuse and are bent 90° so that they form connector tabs which engage the axially inner end surfaces of caps 2 to which they are conductively connected, ss by blind solder joints 5.

Both the necks 4*b* in the silver portion 4*a* of the fusible element 4 as well as the necks $4b^1$ in the copper portions 4*c* of the fusible element 4 may have the same cross-sectional areas. Since the $i^2 \cdot t$ values of silver are smaller than those of copper, fusion in the silver portion and the copper portion will occur sequentially and thus avoid the generation of voltage surges on blowing.

In the drawings the strong axial heat flow has been indicated by arrows R and the radial heat flow by arrows r.

Furthermore, the drawings show clearly that the invention is not limited to fuses whose fusible elements have a single neck. The fusible silver portion 4*a* of element 4 has two necks 4*b* and each of the axially outer copper portions has one neck $4b^1$.

There are three $i^2 \cdot t$ values for silver. The first refers to the heating period from room temperature, or about 20 deg.C., up to melting, the second refers to the melting period where the heat of fusion must be supplied without increasing the temperature of the silver, and the third refers to the heating period from liquification to complete vaporization of the silver. The above referred-to $i^2 \cdot t$ values for silver are $5.91 \times 10^8$ (amp/cm$^2$)$^2$·sec.

$1.02 \times 10^8$ (amp/cm$^2$)$^2$·sec.

$1.67 \times 10^8$ (amp/cm$^2$)$^2$·sec.

The interrupting process in a fuse comprises partial liquification which is a state in which the inside of the fusible element is liquid and the outer skin of it is still solid. Then the fusible element breaks up into a number of sausage-like portions between which arcing occurs. Finally most, but not necessarily all, of the fusible element is vaporized. Depending on whether only a portion or all of the fusible element is vaporized, the $i^2 \cdot t$ should include only the two first mentioned $i^2 \cdot t$ values, or all three of them. It should also be kept in mind that the concept of $i^2 \cdot t$ is only strictly applicable where the fusion of the fusible element is strictly adiabatic, which is rarely the case. But this vagueness as to the $i^2 \cdot t$ values has no effect on the soundness of the teaching of the present invention.

I claim as my invention:

1. An electric fuse, particularly for use in connection with solid state devices, including a tubular casing of electric insulating material, a pair of terminal elements closing said casing at the ends thereof, a granular arc-quenching filler inside said casing, a fusible element immersed in said granular arc-quenching filler and conductively interconnecting said pair of terminal elements wherein (a) said fusible element comprises an axially inner substantially planar portion of silver having at least one short circuit neck adapted to initiate circuit interruption when said neck reaches approximately the fusing temperature of silver;

(b) a pair of non-planar axially outer portions of copper each having a larger width and a larger surface than said axially inner portion; and (c) conductive connections interconnecting said axially inner portion and said pair of axially outer portions.

2. An electric fuse as specified in claim 1 wherein said axially outer portions of said fusible element extend axially outwardly in a direction longitudinally of said fuse, are bent 90 degrees into engagement with the inner end surface of the terminal caps thereof and conductively connected with the latter by solder joints.

3. An electric fuse particularly for use in connection with solid state devices including a casing of electric insulating material, a pair of terminal elements closing the ends of said casing; a granular arc-quenching filler inside said casing; a fusible element immersed in said granular arc-quenching filler and conductively interconnecting said pair of terminal elements wherein (a) said fusible element comprises an axially inner substantially portion of silver planar having at least one short-circuit neck, and a pair of axially outer substantially planar portions of copper only.

(b) said axially outer portions having a much larger width than said axially inner portion; and (c) said axially inner portion and said axially outer portions being conductively interconnected.

4. An electric fuse as specified in claim 3 wherein said axially inner portion is substantially planar, and said axially outer portions are in part U-shaped in cross-section.

5. An electric fuse as specified in claim 4 wherein said axially outer portions each include a web portion and flange portions, said web portion being longer than said flange portions, and wherein each of said web portions are bent 90 degrees into engagement with the axially inner end surfaces of a pair of terminal caps and conductively connected to said end surfaces.

* * * * *